US008698626B2

(12) United States Patent
Eskildsen et al.

(10) Patent No.: US 8,698,626 B2
(45) Date of Patent: Apr. 15, 2014

(54) DOOR BLOCKER WITH WIRELESS ATTACK SENSOR

(75) Inventors: Kenneth G. Eskildsen, Great Neck, NY (US); Robert E. Lee, Garden City, NY (US); Mark D. Okeefe, San Diego, CA (US)

(73) Assignee: Honeywell International Inc., Morristown, NJ (US)

( * ) Notice: Subject to any disclaimer, the term of this patent is extended or adjusted under 35 U.S.C. 154(b) by 238 days.

(21) Appl. No.: 13/240,553

(22) Filed: Sep. 22, 2011

(65) Prior Publication Data

US 2013/0076513 A1 Mar. 28, 2013

(51) Int. Cl.
*G08B 13/00* (2006.01)

(52) U.S. Cl.
USPC ..... 340/565

(58) Field of Classification Search
USPC ..... 340/565, 539.1, 542, 545.1, 547, 548; 70/91, 276
See application file for complete search history.

(56) References Cited

U.S. PATENT DOCUMENTS

| | | | | |
|---|---|---|---|---|
| 4,079,973 | A * | 3/1978 | Hollins | 292/264 |
| 4,600,226 | A * | 7/1986 | Christen et al. | 292/264 |
| 5,499,014 | A * | 3/1996 | Greenwaldt | 340/539.11 |
| 6,310,548 | B1 * | 10/2001 | Stephens et al. | 340/540 |
| 6,977,570 | B2 * | 12/2005 | Gilmore | 335/207 |
| 2011/0056252 | A1 * | 3/2011 | Simpson | 70/77 |

* cited by examiner

*Primary Examiner* — Phung Nguyen
(74) *Attorney, Agent, or Firm* — Husch Blackwell LLP

(57) ABSTRACT

A door blocker includes a wireless transmitter coupled to a forced entry sensor. In response to sensing a stressed blocking element the transmitter emits an alarm indicator. At the same time, the blocking element continues to limit movement of the door relative to the frame to exclude an intruder.

19 Claims, 5 Drawing Sheets

DOOR BLOCKER WITH WIRELESS ATTACK SENSOR

FIELD

The application pertains to locks or guards for doors which permit a respective door to be partly opened while still providing a blocking function. More particularly, the application pertains to chain locks or rigid, pivotable guards which can transmit indicators of an attempted forced entry of the premises protected by the lock, or guard.

BACKGROUND

Home invasion is the act of forcibly entering an occupied dwelling with a violent intent. It differs from burglary as it usually includes acts of kidnapping, rape, assault, or murder. The main entry point for home invaders is often the front door; forcing their way in when the door is opened by an occupant. Products exist on the market, for example door chains as illustrated in FIG. 1A, that allow the door to be opened partially. These products provide a first level of protection. FIG. 1B illustrates a known method of safe guarding a door with a known chain structure, as in FIG. 1A.

FIG. 1C illustrates an alternate embodiment of a door blocker with a door mountable plate. A second plate is mountable on an adjacent door frame. The second plate carries a pivotable, rigid blocking member which can slidably engage a portion of the door mountable plate. The door can only be partly opened when the pivotable member slidably engages the door mounted plate.

While useful, these products can be overcome with force. Thus, it would be desirable to have a security device installable on an entry door that can notify a central monitoring station of a forced entry attempt.

DETAILED DESCRIPTION

Figure 1A:
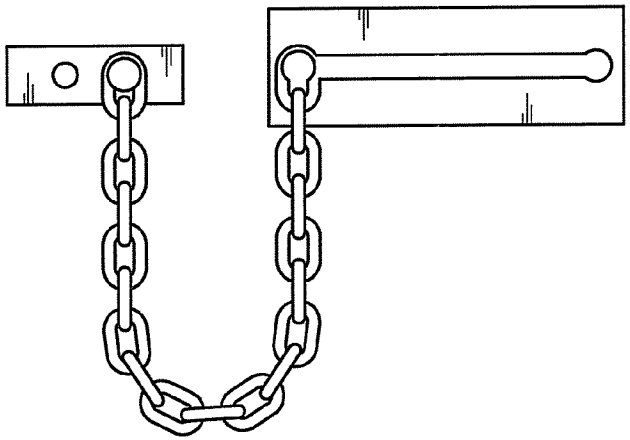
(PRIOR ART) FIG. 1A
FIG. 1A illustrates a prior art door blocker which incorporates a locking chain.
Figure 1B:
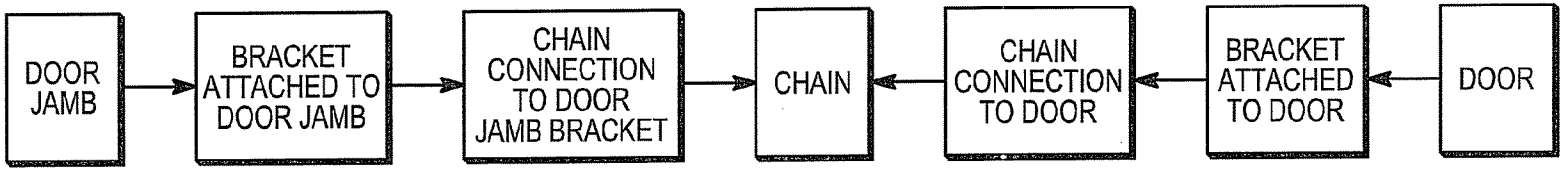
(PRIOR ART) FIG. 1B
FIG. 1B is a diagram indicative of a prior art installation process.
Figure 1C:
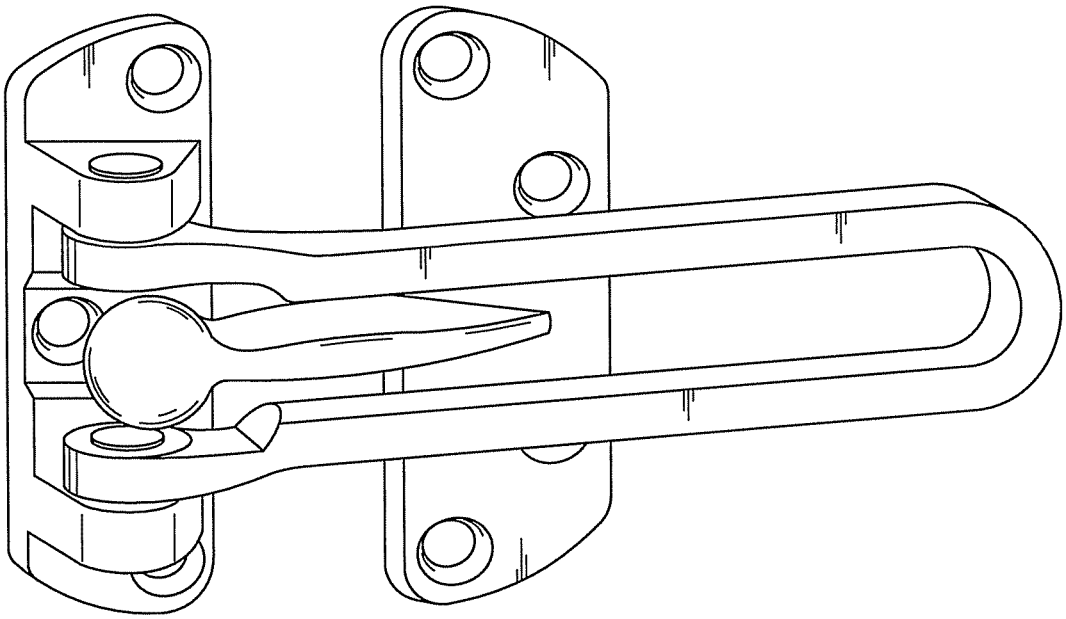
(PRIOR ART) FIG. 1C
FIG. 1C illustrates an alternate prior art door blocker which incorporates a pivotable, rigid, blocking member.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

Door blockers in accordance herewith generate a door open indicator which can be transmitted wirelessly, or via cables to either or both of a local alarm control panel, and a displaced monitoring station. An alarm indictor is automatically transmitted in response to the door blocker being stressed, for example due to an attempted forced entry.

In another aspect, an apparatus in accordance herewith provides a solution to the above noted problem by providing an extra level of protection in a chain door lock, or a door guard having a rigid door blocking element. A chain lock or guard is fitted with a wired or, wireless transmitter.

Relative to the door guard, the rigid element can be pivotably attached to a plate which can be fixedly mounted on a door frame. The element can slidably engage a door mounted plate. The door can be partly opened when the element slidably engages the door mounted plate.

The blocking mechanism allows the door to be partially opened. Partly opening the door can cause the transmitter to send a "door open" signal, even if the associated alarm system is disarmed and not active. A forced entry attempt which stresses the chain or the guard will automatically generate an alarm signal. The forced entry attempt could be detected mechanically, optically, or electrically.

An exemplary electro-mechanical embodiment includes providing two anchor points for a blocking chain. An anchor point, located closest to the door, is designed to break-away before an anchor point positioned further from the door. In one aspect, the anchor point closest to the door can be magnetized so that it can activate a magnetic sensor located within the housing of the transmitter.

If a forced entry occurs when the door chain is attached to the door, the anchor point closest to the door breaks away. This break away is sensed by the magnetic sensor and can then be transmitted as an alarm signal to a displaced monitoring system control panel.

In yet another aspect, control circuitry of a wireless transmitter can incorporate a reed switch in close proximity to the magnetized anchor point. The magnetic field of the anchor point causes the reed switch to be in a closed state. The control circuitry detects the closed state of the reed switch as the normal or restored state and wirelessly communicates this to the displaced alarm control panel.

When a forced entry is attempted with the chain in the deployed position, the magnetic anchor point will break away, thus removing the magnetic field from the reed switch. The reed switch then becomes open circuited, exhibiting an open state. This open state is detected by the control circuits and is wirelessly communicated to the control panel and/or a displaced monitoring station.

Additionally, a manual panic switch can be provided, coupled to the transmitter. A pull-cord switch or push button can be used. When activated it will send a panic alarm to the control panel and/or a displaced monitoring station.

A reed switch can be activated by a door open magnet affixed to the door. The reed switch can be used to detect the open/close state of the door and to send a door open RF message to the control panel and/or a displaced monitoring station.

Additionally, the door chain transmitter can provide additional features. One feature allows manual activation of a panic alarm should the occupant feel threatened. Another feature, discussed above, senses that the door has been opened. This is useful for control panel's processing of alarms.

Figure 2A:
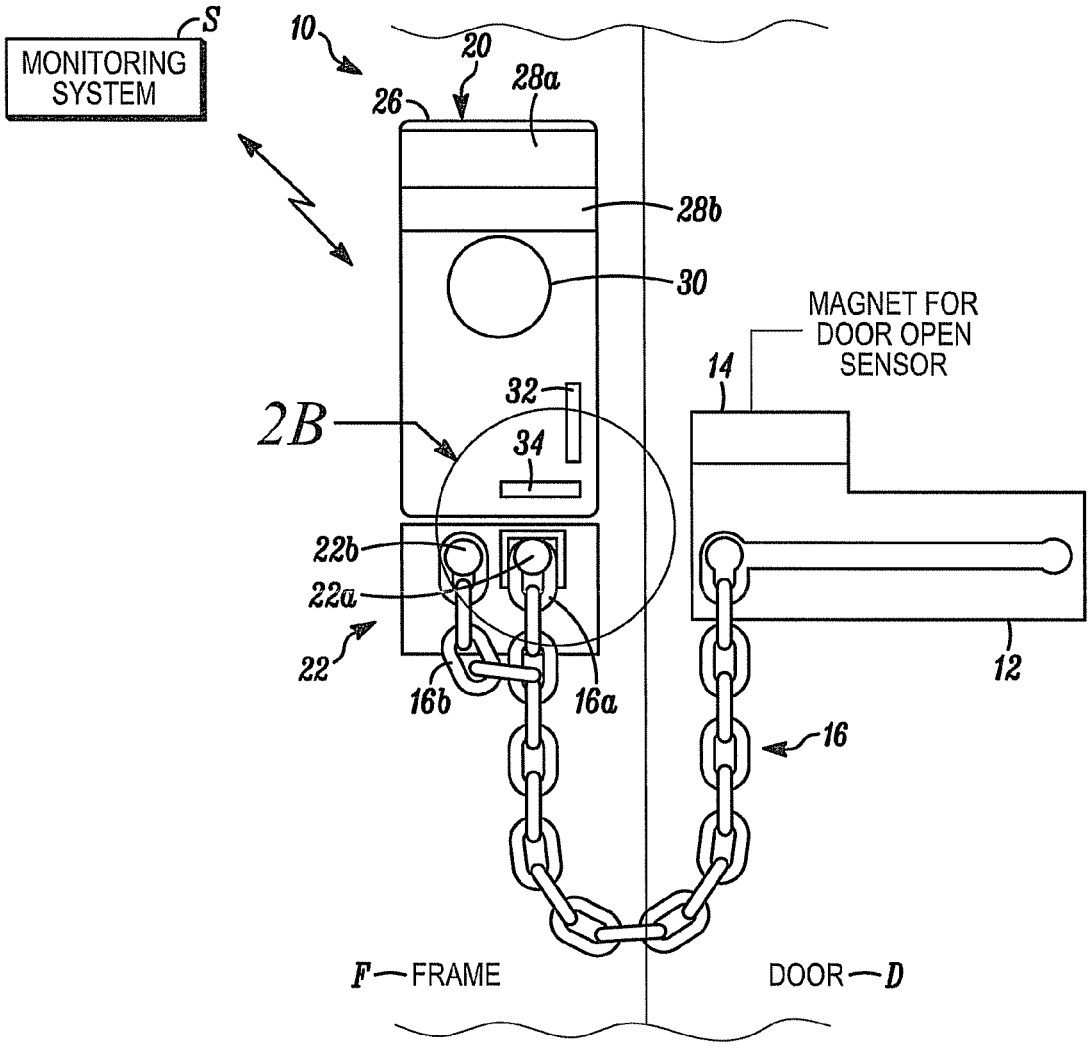
FIG. 2A illustrates a door blocker which incorporates a door blocking chain in accordance herewith attached to a door.
Figure 2B:
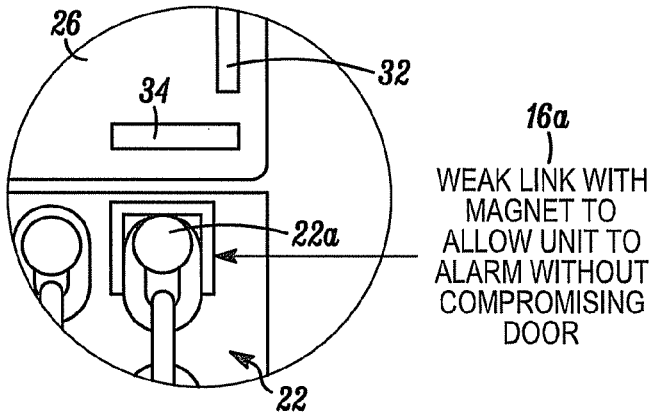
FIG. 2B illustrates an enlarged portion of FIG. 2A.
Figure 3:
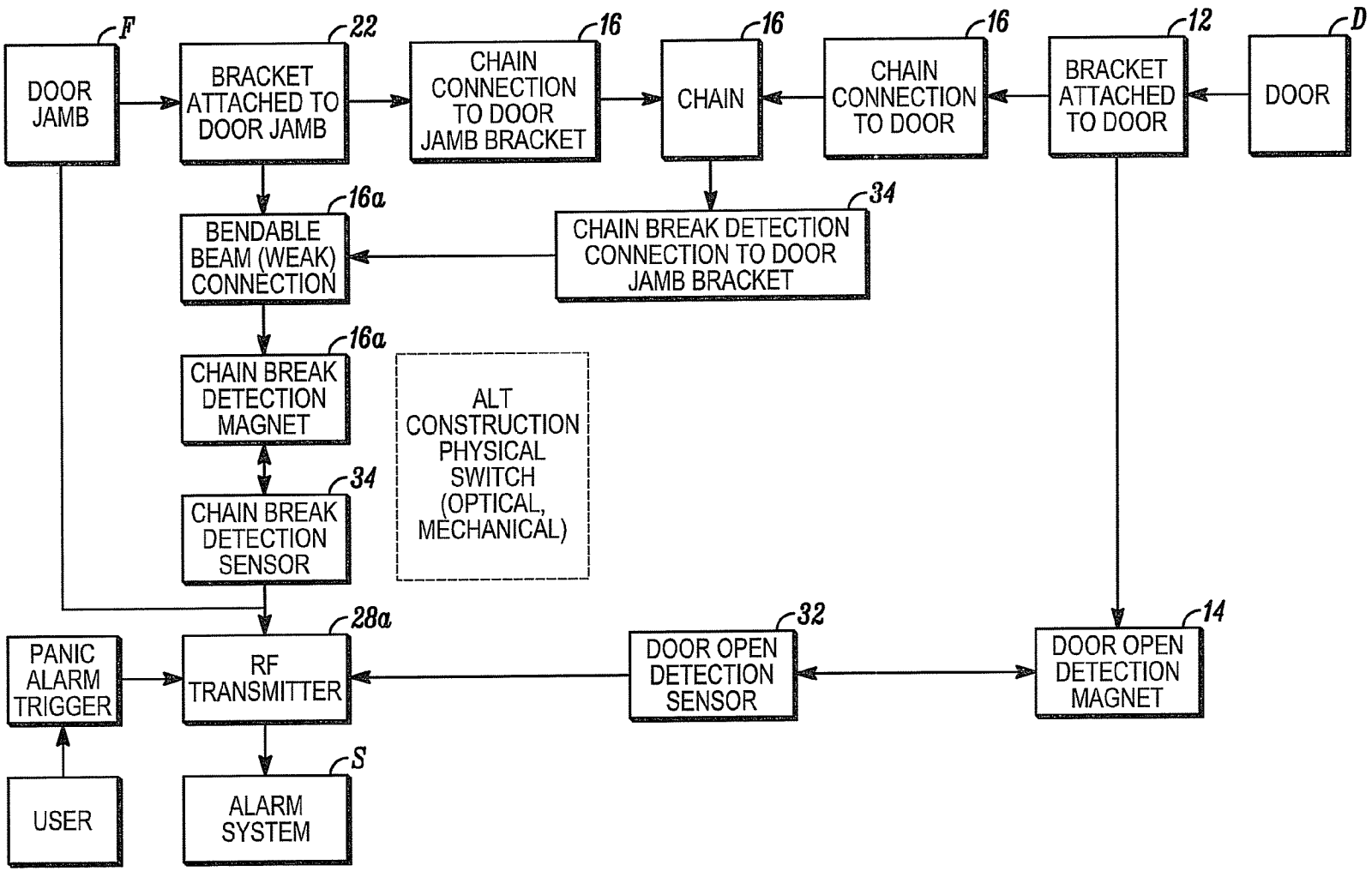
FIG. 3 is a diagram of a process in accordance herewith.

FIGS. 2A and 3 illustrate a chain-type door lock, door blocker, 10 which provides wireless alarm signaling of an attempted forced entry. Lock 10 includes a door mountable slide plate 12 and a door open magnet 14. A chain 16 can slidably engage the plate 12 to provide a door blocking function such that door D can be opened partly, relative to frame F while still providing a security function.

Door blocker 10 includes a transmitter unit 20, and an associated chain plate 22 both of which can be mounted on the frame F adjacent to the door open magnet 14. Unit 20 includes an exterior, door mountable, housing 26.

Housing 26 carries a wireless transmitter 28*a* for communicating with a displaced security monitoring system S. The transmitter 28*a* is coupled to control circuits 28*b* which could be implemented, at least in part, with a programmable processor and associated control software.

Housing 26 also carries a manually operable "Panic" button 30 which a resident could press in the event of an attempted intrusion. In response thereto, the transmitter 28*a* could send an alarm message to the system S.

Housing 26 also carries a door open sensor 32, for example a reed switch, coupled to the control circuits 28*b*. The sensor 32 responds to movement of magnet 14 as door D is opened.

Housing 26 carries a chain break sensor 34, also coupled to control circuits 28*b* which can respond to movement, or breakage of a link 16*a* of chain 16 which is not as strong as the links 16*b*, both of which are fixedly attached to plate 22. As those of skill in the art will understand, the link 16*a* could be magnetic and attached to plate 22 for limited rotary motion. If an intruder attempts for force the door D open, the link 16*a* can swivel on mounting pin 22*a*, and if enough force is applied, link 16*a* can break moving away from sensor 34. Sensor 34, which could be a reed switch, will change state, in response to movement of the link 16*a*, and the control circuits 28*b* can activate the transmitter 26 to send an alarm indicating message to system S.

As illustrated in FIG. 2A, the chain segment 16*b*, which is longer than link 16*a*, is attached to plate 22 via mounting pin 22*b*, and, will not break at the same time as link 16*a*. Hence the unit 20 can both automatically emit an alarm indicating wireless signal to system S while still blocking movement of the door D from the frame F, and excluding the intruder.

It will be understood that other types of chain break sensors could be used without departing from the spirit and scope hereof. For example, optical sensing could be used to detect breakage of link 16*a*.

Figure 4:
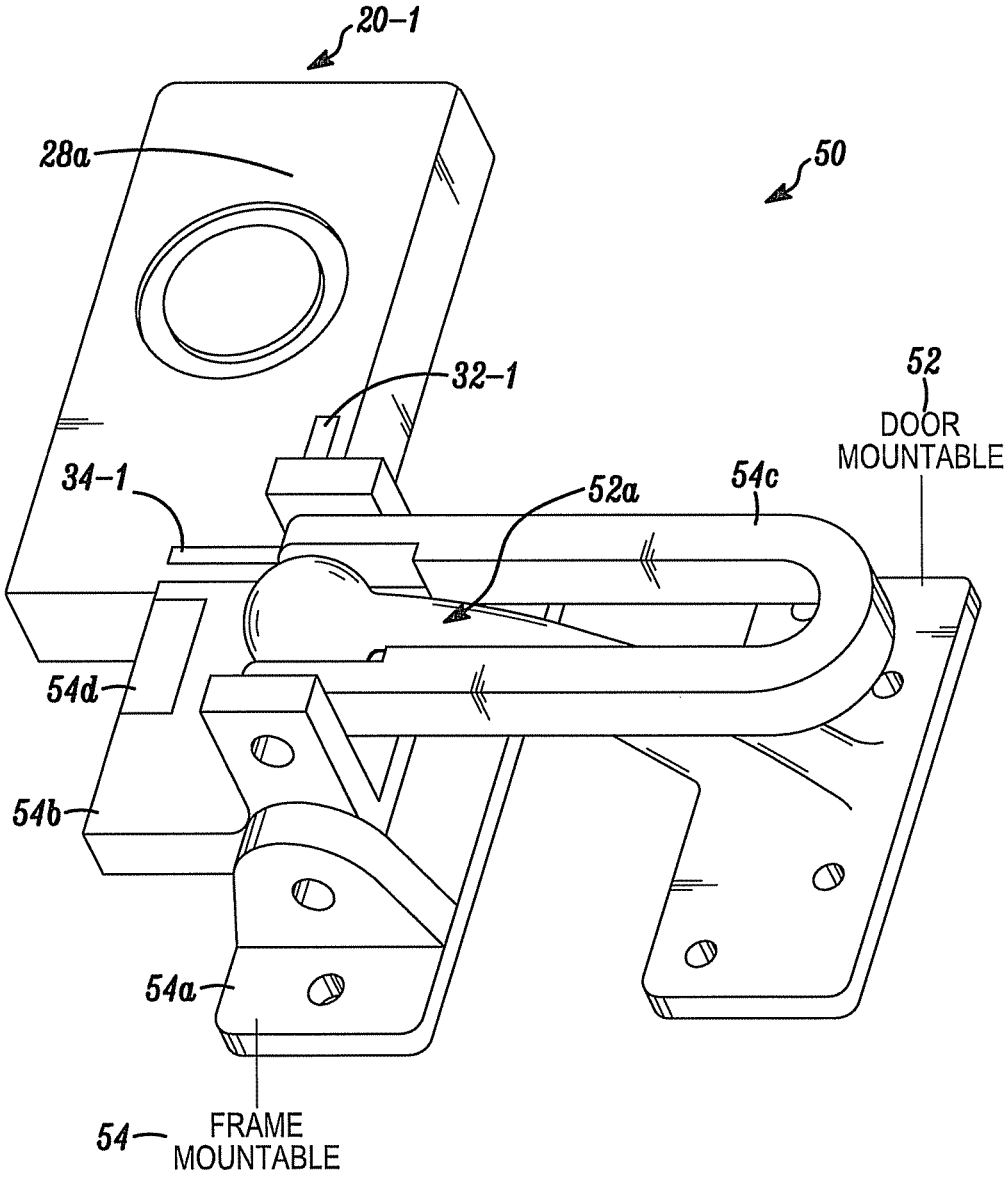
FIG. 4 illustrates an alternate form of a door blocker which incorporates a rigid door blocking element.

FIG. 4 illustrates an alternate embodiment of a door blocker 50 in accordance herewith. The door blocker 50 includes a door mountable portion 52 which carries an integrally formed blocking arm indicated generally at 52*a*.

A frame mountable portion 54 includes a plate 54*a* attachable to a frame, such as frame F of the door to be blocked, such as door D of FIG. 2A. The plate 54*a* carries a coupling element 54*b*. The coupling element 54*b* carries a pivotably mounted U-shaped blocking member 54*c*, which can slidably engage arm 52*a*, as illustrated in FIG. 4.

The engagement with the arm 52*a* permits the associated door D to open a predetermined distance, before being blocked from further movement. Alternately, the member 54*c* can be rotated away from the arm 52*a* which enable the door D to be opened without generating an alarm signal as discussed below.

The coupling element 54*b* is attached to the plate 54*a* by frictional pivot points which permit the element 54*b* to rotate in response to a force being applied to the door D by someone trying to force it open. The coupling element 54*b* also carries a magnet 54*d*. The magnet 54*d* moves when the element 54*b* moves in response to the force being applied to the door D.

A transmitter and associated circuits 20-1, comparable to the transmitter and circuits 20 discussed previously, can be mounted on the door frame adjacent to the magnet 54*d*. Movement of the magnet 54*d* can be sensed by a rotation sensor 34-1, comparable to the sensor 34 of FIG. 2A. Sensor 34-1 could be implemented as a reed switch.

In response to the reed switch changing state, the transmitter 28*a* can automatically emit an alarm signal, as discussed above, to a displaced monitoring system and station S irrespective of the status of a local monitoring system. Alternately, movement of the coupling element 54*b* can mechanically produce a switch closure, or optically produce a movement indicating signal.

The door mountable portion 52 can also carry a door open magnet 14-1, comparable to the magnet 14 discussed above, which a door open sensor 32-1, comparable to the sensor 32, can detect prior to the force on the door causing the coupling element 54*b* (and magnet 54*d*) to move in response the applied force.

Those of skill will understand that the above discussions of door blockers 10 and 50 are exemplary only. Variations thereof come within the spirit and scope hereof.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A door blocker comprising:

a housing coupled to one of a door and a frame of the door;

a wireless transmitter, carried by the housing, that transmits a door open indicator to a local security monitoring system;

a blocking mechanism carried by the housing that at least partially blocks opening of the door;

first and second anchor points of the door blocking mechanism coupled to the other of the door and the frame, the first anchor point breaks away from the blocking mechanism during a forced entry attempt; and a forced entry sensor, carried by the housing and, coupled to a blocking mechanism, the forced entry sensor is responsive to an indicium of the blocking mechanism that is indicative of the first anchor point breaking away during the forced entry attempt and changes state in response to the indicium where in response to the changed state of the forced entry sensor, the transmitter automatically transmits an alarm signal to a displaced security monitoring system irrespective of a status of the local security monitoring system.

2. A blocker as in claim 1 where the indicium is at least one of mechanically generated, optically generated, electrically generated, or, magnetically generated.

3. A blocker as in claim 2 which includes a proximity sensor which when the members are in a first position relative to one another, couples a first output to the housing, and when the members are in a second position, relative to one another, couples a different output to the housing.

4. A blocker as in claim 3 which includes control circuits responsive to at least the first output to transmit an indicator thereof.

5. A blocker as in claim 4 which includes a first plate couplable to a door and where in the blocking mechanism can be releasibly coupled thereto.

6. A blocker as in claim 5 and a second plate with one of a chain, or a rigid blocking element attached thereto.

7. A blocker as in claim 6 where the housing is associated with one of the plates.

8. A blocker as in claim 7 where the chain includes first and second sections, where one section is breakable before the other.

9. A blocker as in claim 1 which includes one of a chain attachable to permit movement between first and second members, or a rigid blocking member which permits movement between first and second members.

10. A blocker as in claim 9 where the chain is selectively breakable thereby producing the indicium.

11. A blocker as in claim 10 which includes the transmitter, carried by the housing, coupled to the forced entry sensor and where the transmitter forwards a signal indicative of a broken chain.

12. A blocker as in claim 11 where the transmitter, prior to the chain breaking, forwards a door open signal.

13. A blocker as in claim 9 where the housing has an attachment feature attachable to one of the members.

14. A blocker as in claim 13 has first and second sets of links, and where the chain is selectively breakable on one set of links thereby producing the indicium.

15. A door blocker comprising:

a housing coupled to one of a door and a frame of the door;

a transmitter, carried by the housing, that transmits a door open indicator to a local security monitoring system;

one of a flexible blocking element or a rigid blocking element couplable to a selected attachment plate located on the other of the door and the frame;

first and second anchor points of the one of the flexible blocking element or the rigid blocking element, each coupled to the housing, the first anchor point breaks away from the housing during a forced entry attempt; and forced entry sensing circuits, carried by the housing and, responsive to an indicium indicative of the first anchor point breaking away from the housing, the circuits emit an indicator thereof, the transmitter automatically transmits the indicator to a displaced security monitoring system irrespective of a status of the local security monitoring system.

16. A door blocker as in claim 15 where the sensor responds to a change of state of the blocking element.

17. A door blocker as in claim 15 which includes a door open sensor which provides an input to the circuits carried by the housing.

18. A door blocker as in claim 15 which includes the transmitter, carried by the housing which is coupled to the sensor, and transmits the indicium to a displaced location.

19. A door blocker as in claim 15 where the forced entry sensor is selected from a class which includes at least an optical sensor, a mechanical sensor, an electrical sensor and a magnetic sensor.

* * * * *